US007192160B2

(12) United States Patent
Reiff, Jr. et al.

(10) Patent No.: US 7,192,160 B2
(45) Date of Patent: Mar. 20, 2007

(54) LIGHT FIXTURE

(75) Inventors: David L Reiff, Jr., Bluffton, IN (US); Paul J Reiff, Bluffton, IN (US); Clyde M Brown, Hebron, IN (US)

(73) Assignee: General Manufacturing, Inc., Bluffton, IN (US)

( * ) Notice: Subject to any disclaimer, the term of this patent is extended or adjusted under 35 U.S.C. 154(b) by 98 days.

(21) Appl. No.: 10/889,411

(22) Filed: Jul. 12, 2004

(65) Prior Publication Data

US 2006/0007682 A1 Jan. 12, 2006

(51) Int. Cl.
*F21V 9/00* (2006.01)

(52) U.S. Cl. ..... 362/231; 362/228; 362/260

(58) Field of Classification Search ..... 362/230, 362/231, 260, 295, 228
See application file for complete search history.

(56) References Cited

U.S. PATENT DOCUMENTS 5,060,118 A * 10/1991 Penrod et al. ..... 362/1
6,062,706 A * 5/2000 Owen ..... 362/231
6,126,303 A * 10/2000 Gross ..... 362/544
6,932,492 B2 * 8/2005 Tumlinson et al. ..... 362/228

* cited by examiner

*Primary Examiner*—Sandra O'Shea
*Assistant Examiner*—James W Cranson, Jr.
(74) *Attorney, Agent, or Firm*—Baker & Daniels LLP

(57) ABSTRACT

A light for use in applications requiring conventional and specialized, dimmable lighting wherein the color of the emitted light can easily be switched. The light includes fluorescent and/or LED light sources which are dimmable by a control box. The control box further allows for switching between two light sources provided in the light. The light sources may provide white light or specialized light including red or blue "invisible" light required in some military applications or UV lighting.

18 Claims, 4 Drawing Sheets

LIGHT FIXTURE

BACKGROUND OF THE INVENTION

1. Field of the Invention

The present invention relates to lighting having multiple sources of light particularly useful for specialized industrial or military applications. In particular, this invention relates to such a light wherein the color of light emitted can be changed by an in line switch.

2. Description of the Related Art

In general, lighting is necessary for a multitude of industrial and military applications including in warehousing areas, military tents, and military vehicles. In some of these applications, specialized lighting may be required. Such specialized lighting includes the use of "invisible" light, e.g., the use of a red or blue light for tasks including map reading, tent lighting, or cockpit lighting. Other specialized lighting may include infrared light for night vision, and UV lights used for curing epoxies or detecting leaks.

With particular regard to the military applications, conventional fluorescent lamps used to illuminate tents, for example, produce white light which is not "invisible" light. The light produced by fluorescent lamps may be detectable, and is therefore undesirable. In order to provide invisible light, a light source emitting red or blue light, for example, may be used. The red or blue light may be provided by placing a covering over a fluorescent light, the use of a colored incandescent bulb, or colored Light Emitting Diodes (LEDs). When such lights are mounted in a position which is not readily accessible, it is difficult and time consuming to snap such covers on to change the color of the emitted light. The use of incandescent bulbs is undesirable as the life of the bulb is much less than that of a fluorescent lamp. Additionally, the heat produced by incandescent bulbs is greater than a fluorescent lamp and may also be detectable. Finally, many conventional lights are not sufficiently sturdy for industrial/military applications.

In an industrial area, UV lighting may be used for curing applications such as paint or epoxies. The UV light may also be used to detect leaks in automobiles or in fluid systems such as heating and cooling systems, for example.

When specialized lighting is used or is necessary for a task, the light having a red, blue, infrared, or UV light source is often a portable light which must be transported between areas. These specialized lights may not be large enough to illuminate a large tent as a, e.g., command center or curing room. Alternatively, if the lights are large, they are cumbersome and not easily transferred between areas.

It is desired to provide a light having the capability of producing both conventional and specialized light colors for an area while being sturdy and durable enough to endure harsh and extreme environments, and wherein the color of the emitted light can be switched by means of an in line switch.

SUMMARY OF THE INVENTION

The present invention provides an improved light for use in applications requiring both conventional and specialized, dimmable lighting in several areas including industrial or military.

The lights have a transparent tubular housing portion with end caps located at opposite end of the housing member. Mounted within the housing is a plate to which the light source is mounted. The plate may be in the form of a circuit board for mounting of LEDs. Extending from one end cap is an electrical cord having a plug at the distal end thereof. A control box for operating the light is located along the cord. The opposite end cap is provided with a service receptacle or electrical outlet, or a polarized connector for facilitating connection of the lights in series. In addition, an electrical device such as a tool may be plugged into the electrical service outlet of the light. The series of lights may have a master/slave configuration in which all the lights in the series are controlled by one control box. Alternatively, each light in the series may be provided with a control box for independently controlling each light. The lights are dimmable and may easily be switched between the white, red, specialized red, blue, or in some cases UV, light sources. The construction of the light is such that the light can withstand the harsh, extreme conditions associated with the different industrial or military applications, for example.

The present invention comprises, in one form thereof, a light fixture having a base and two light sources mounted on the base. Each of the light sources emits a different color of light. A control is provided for selectively energizing one or another of the light sources, whereby the light fixture emits one or another color of light.

An advantage of the present invention is that the light may be provided with both a conventional white light source and a specialized light source such as red, blue, or UV lights.

A further advantage of the present invention is that the light is easily operable between the multiple light sources and is dimmable.

An additional advantage of the present invention is that the lights may be interconnected to form a string of lights used to illuminate a large area with the lights being operable by one control box or by individual control boxes located between each pair of lights.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
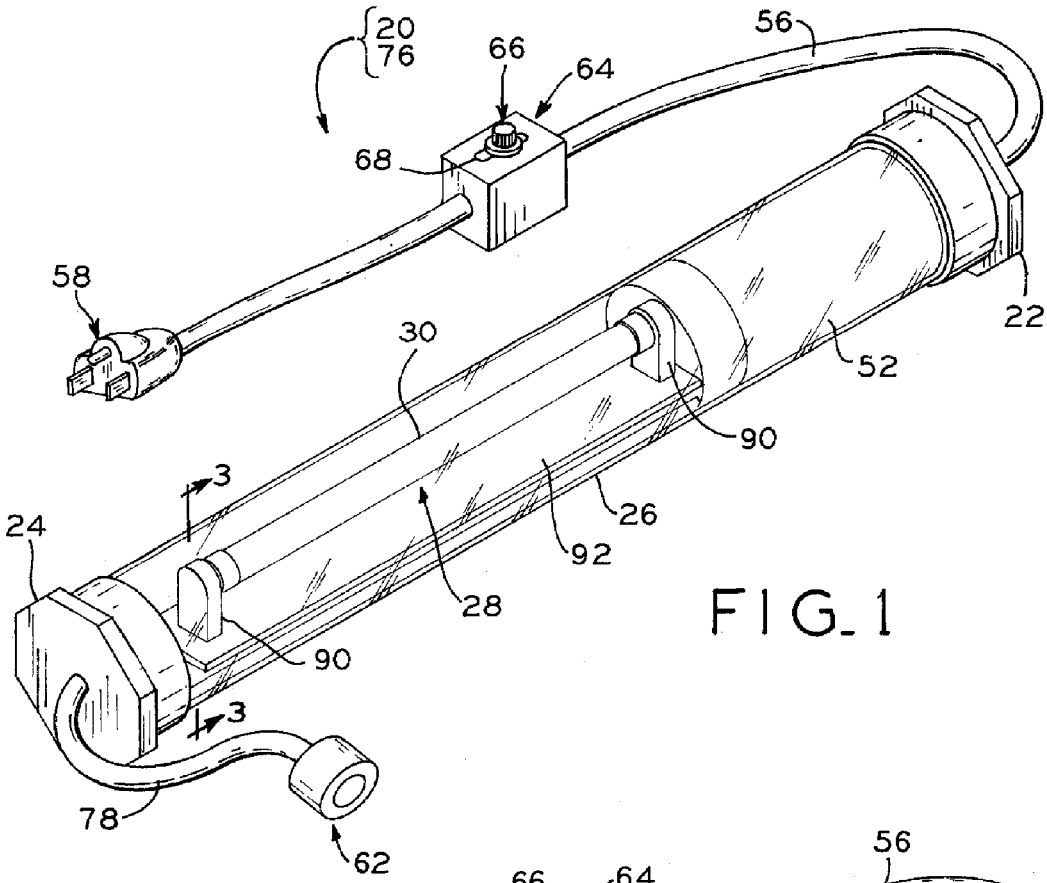
FIG. 1 is a perspective view of a light in accordance with the present invention.

Corresponding reference characters indicate corresponding parts throughout the several views. Although the exemplification set out herein illustrates several embodiments of the invention, in one form, the embodiments disclosed below are not intended to be exhaustive or to be construed as limiting the scope of the invention to the precise forms disclosed.

DESCRIPTION OF THE PRESENT INVENTION

Referring to FIGS. 1–9, shelter or work lights such as those shown in the illustrated embodiments may provide both conventional and specialized, dimmable lighting in a single light for use in industrial or military applications, for example. Such lights may be anywhere from 1 foot to 8 feet in length and are designed to illuminate a military vehicle as well as large areas including rooms or tents. The lights are constructed to be very durable and able to endure harsh and extreme environments in which they may be used. The lights of the present invention relate to the work lights described in U.S. patent application Ser. No. 10/119,555 which is assigned to the assignee of the present invention, the disclosure of which is hereby incorporated herein by reference.

Light 20 of the present invention is generally tubular having two end caps 22 and 24 engaging opposite ends of a transparent housing 26 (FIGS. 1, 2, 5, and 7). Transparent housing 26 extends the length of the light and encases light source or sources 28 mounted therein. Housing 26 and end caps 22 and 24 are constructed from a durable material such as plastic by any suitable method including molding, for example.

Light sources 28 used in the embodiments of the lights described hereinbelow may include fluorescent lamps 30 and LEDs 32. Fluorescent lamps 30 are conventional lamps which emit white light. In general, fluorescent lamps produce significant amounts of light, approximately 63 lumens of light per watt sufficient to illuminate any of the above described areas.

LEDs 32 have a life that is much greater than that of a fluorescent or incandescent lamp. LEDs which emit white light generate approximately 12 lumens of light per watt of power. Therefore, only 5 LEDs are required to produce the same amount of light per rated watt of the conventional fluorescent lamp.

LEDs have an outer shell in which an active substance such as a phosphor compound, gallium nitride, or gallium arsenide is contained. When electrical current is supplied to the LEDs, the active substance is excited causing the emission of visible light. The color of the LED is determined by the color of the outer shell or the type of active substance located in the LED. The LEDs may be of any suitable type emitting white light, or red, blue, or infrared "invisible" light which is of particular use in military applications. Additionally, the LEDs may emit UV light which is useful in leak detection or curing applications in industrial areas. LEDs may be purchased from several sources including LEDtronics, Inc., 4009 Pacific Coast Highway, Torrence, Calif.; Chicago Miniature Lamp, Inc., 147 Central Avenue, Hackensack, N.J.; Q.T. Optoelectronics, 610 North Mary Avenue, Sunnyvale, Calif.; Lumex Optocomponents, Inc., 292 East Hellen Road, Palatine, Ill.; and Gelcore, 6180 Halle Drive, Valley View, Ohio.

Figure 6:
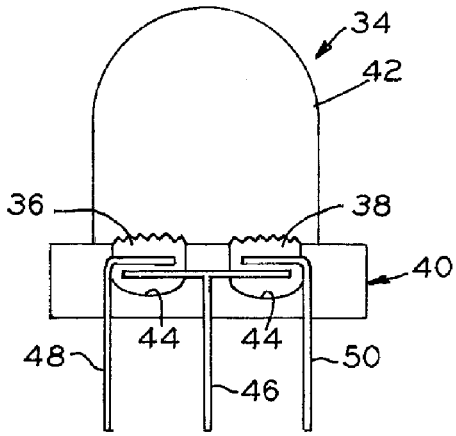
FIG. 6 is a sectional view of a dual color LED.

Referring to FIG. 6, LEDs 32 may be a dual color LED 34 in which the LED is provided with two different types of active substances or illuminating material 36 and 38. LED 34 includes base 40 and dome-shaped transparent cover 42. Illuminating material 36 and 38 is located in cups 44 integrally formed in base 40 with common electrode 46 engaging both materials. Electrodes 48 and 50 are also provided with each electrode being embedded in one of illuminating materials 36 and 38. When electrical current is supplied to electrode 48 of LED 34, illuminating material 36 is excited and LED 34 emits a first color, red or white for example. When electrical current is supplied to the second electrode 50, the second illuminating material 38 is excited and LED 34 emits the second color.

Figure 2:
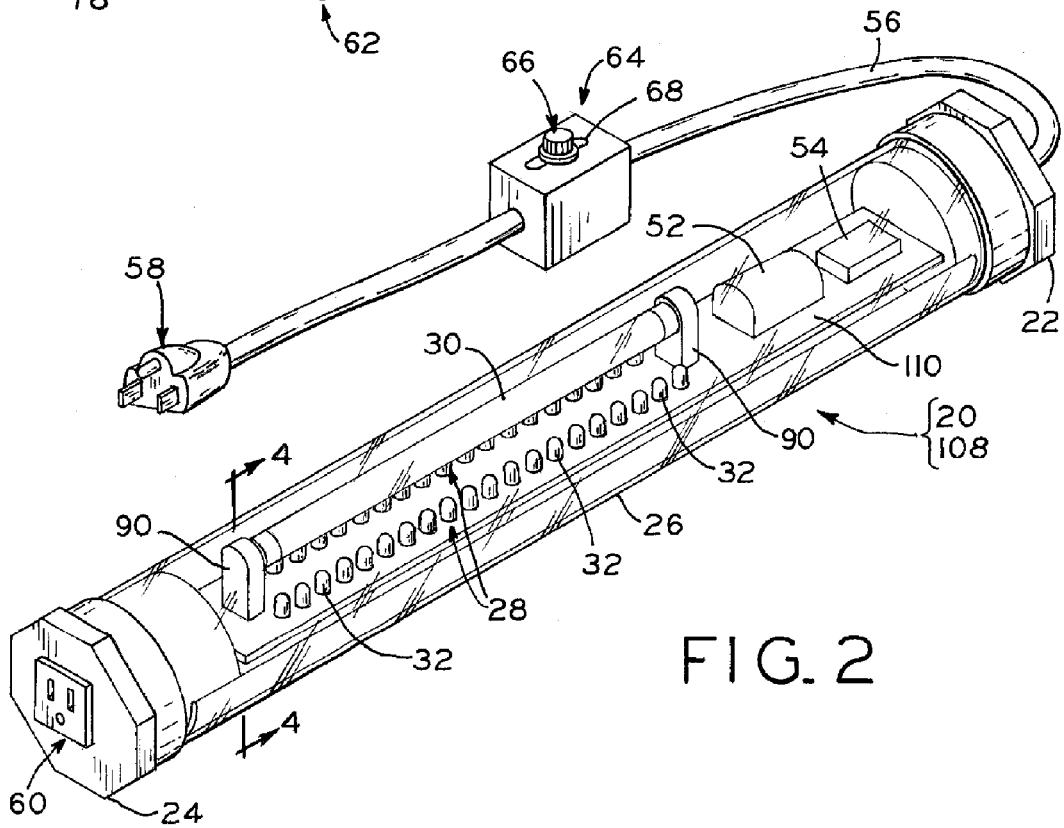
FIG. 2 is a perspective view of an alternative embodiment of a light in accordance with the present invention.

The embodiments of the lights 20 discussed hereinbelow may be operated from any typical supply of 120 to 240-volt AC power, a DC generator, a battery, or a battery pack, for example. Lights 20 are provided with the appropriate electrical components depending on the type of light source and power supply. Referring to FIG. 2, the electrical components include a conventional fluorescent ballast 52 and LED driver 54 which transform input current from a power source into regulated operational current required by the fluorescent lamp 30 and LEDs 32, respectively.

When light 20 is powered by conventional 120-volt power, electrical cord 56 extends from one end 22 of the light having plug 58 at a distal end of the cord for insertion into a conventional electrical outlet. Advantageously, means for electrically linking a series of lights 20 may be provided at the opposite end of the light from electrical cord 56 in end cap 24. These means may include electrical service outlet 60 as shown in FIG. 2 or polarized connector 62 as illustrated in FIG. 1. The polarized connection is a water sealed connection typically used by the military. In addition to linking multiple lights 20, other electrically operated devices such as a tool may be plugged into electrical outlet 60.

Figure 5:
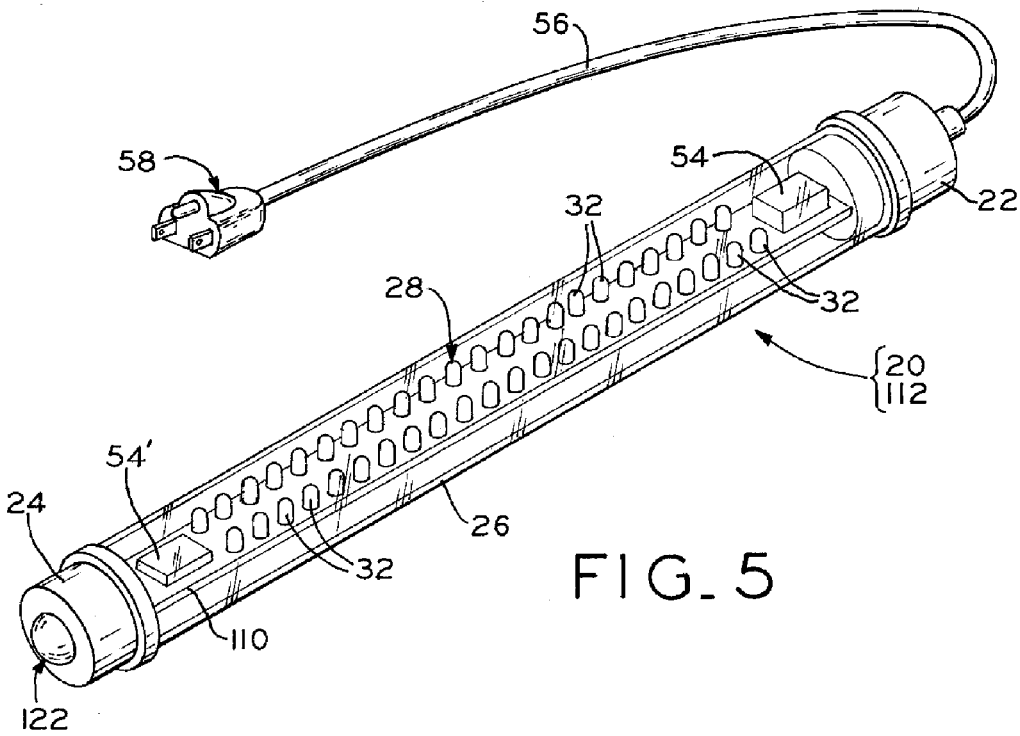
FIG. 5 is a perspective view of a third embodiment of a light in accordance with the present invention.
Figure 7:
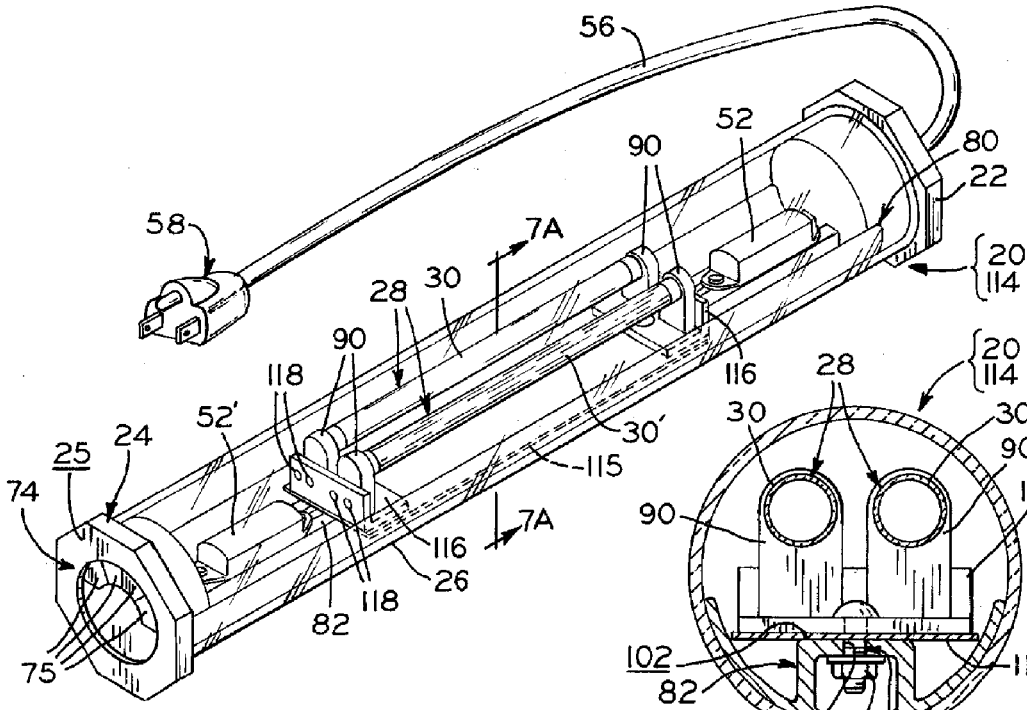
FIG. 7 is a perspective view of a fourth embodiment of a light in accordance with the present invention.
Figure 9:
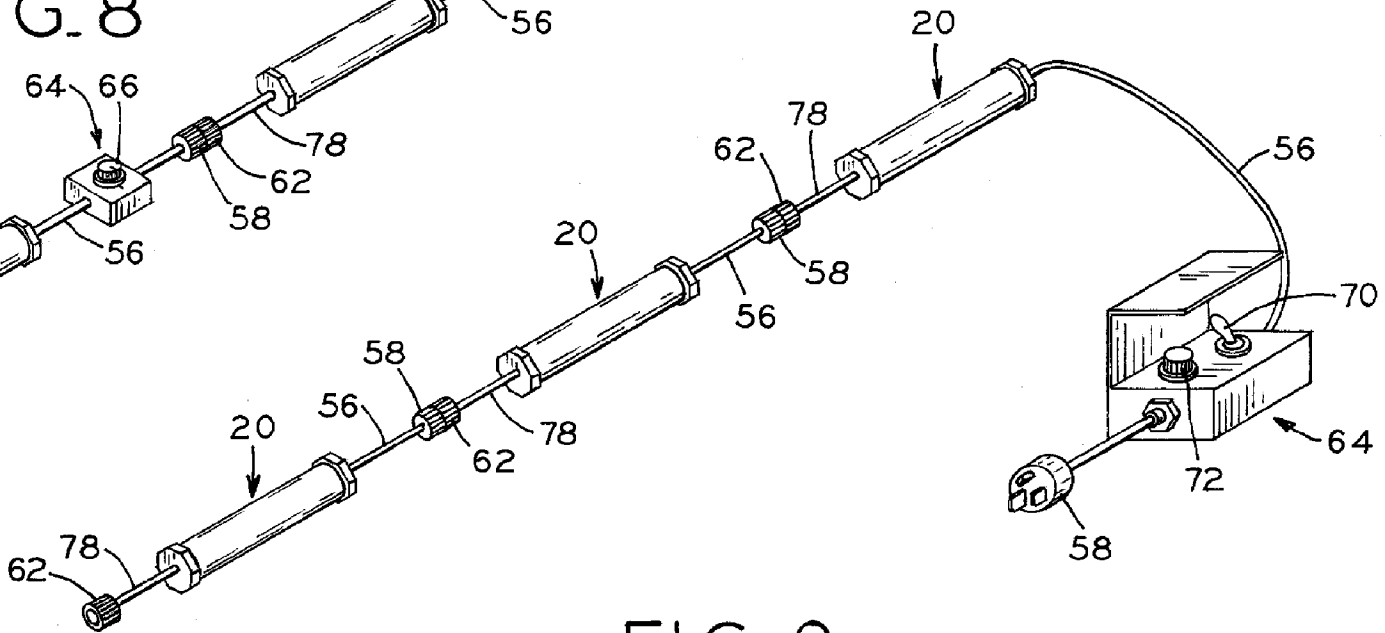
FIG. 9 is a perspective view of a plurality of lights linked in series, the series having a master/slave arrangement operable by a single control box.

Lights 20 may be provided with control box 64 which includes a switch of any suitable type for turning the light on and off and selecting between different light sources 28. Then, either a regular white light fluorescent light source can be selected, or a "colored" LED light source can be selected. Referring to FIGS. 1 and 2, control box 64 may include switch 66 which is a stepped dimmer switch linearly slideable in slot 68 to select light source 28 and rotatable to control the brightness of light source 28. Referring to FIG. 9, control box 64 may include light source selector switch 70 and dimmer knob 72 rotatable to control the brightness of the selected light source 28. Additionally, as shown in FIG. 5, light 20 may be provided with push button stepping switch 122 located in end cap 24. Push button stepping switch 122 may be configured to turn light 20 on and off as well as selectively illuminating one row of LEDs 32 at a time. For example, when push button stepping switch 122 is depressed a first time, one row of LEDs 32 is illuminated. By depressing button 122 again, the illuminated row of LEDs 32 turns off. Actuating push button stepping switch 122 a third time causes the second row of LEDs 32 to be illuminated. Push button stepping switch 122 is illustrated as being located in end cap 24 however; the switch may be conveniently positioned along the side of light 20. Alternatively, as shown in FIG. 7, light 20 may be provided with a membrane switch 74 positioned in end cap 24. Membrane switch 74 is illustrated as being located in end cap 24 however; the switch may be conveniently positioned on the side of the light. Membrane switch may include multiple buttons 75 for operating light 20 including buttons for turning the light on and off, selecting a light source, and increasing or decreasing the intensity of the light. This type of switch eliminates the use of control box 64 and is sealed which may be particularly useful in harsh and extreme environments. Any suitable switch may be used to control light 20 providing the switch has the capability of operating multiple light sources, as well as providing a means for dimming the light source.

Figure 8:
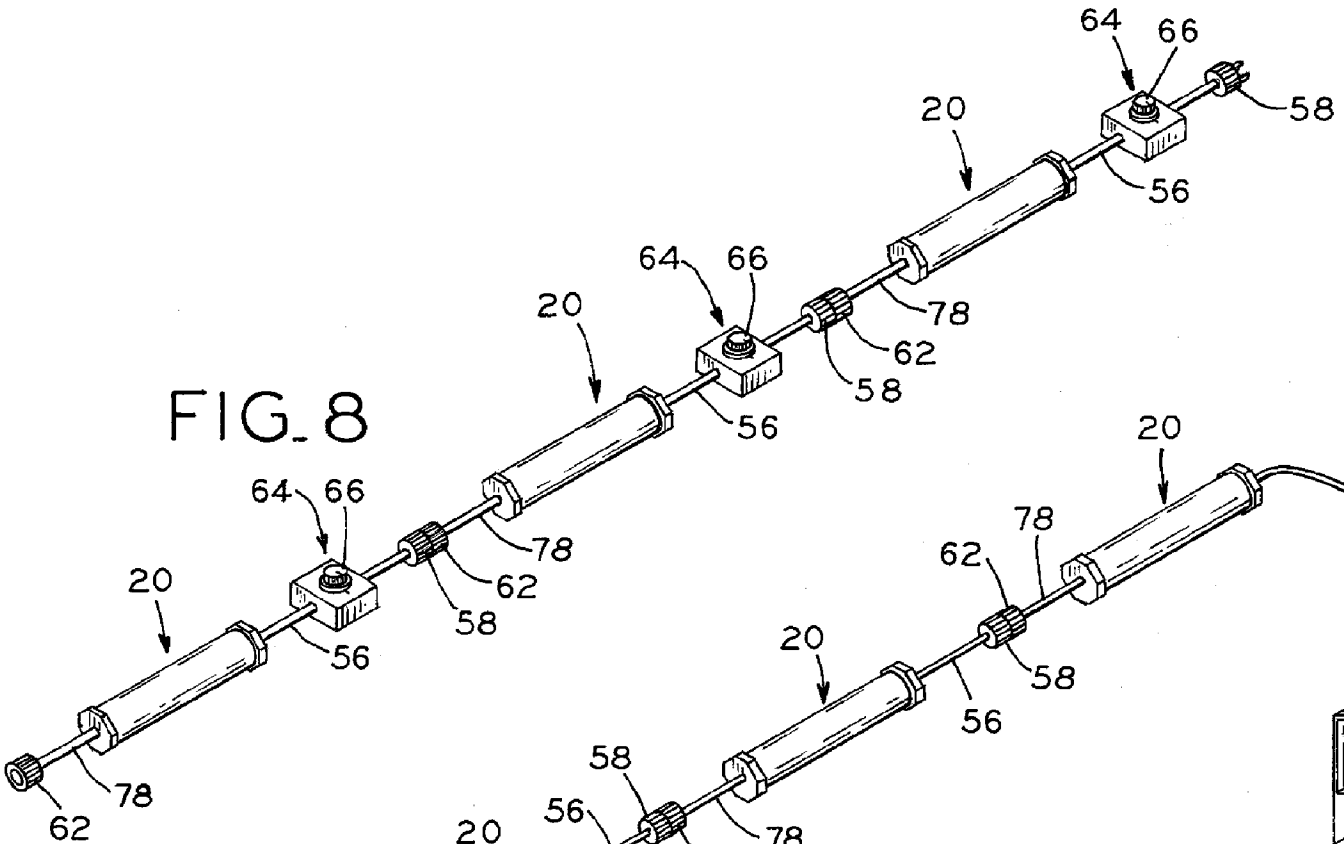
FIG. 8 is a perspective view of a plurality of lights linked in series, each light having an independent control box.

Referring to FIGS. 8 and 9, lights 20 may be electrically linked in series. In the embodiment shown in FIG. 8, each light 20 is provided with a control box 64 allowing each light to be individually operated. This may be advantageous in military barracks for example. Each soldier would have control of his or her own light 20 while requiring only one source of electrical power for the entire string of lights 20. Referring to the embodiment of FIG. 9, lights 20 may be arranged in a master/slave arrangement. The string of lights 20 has one control box 64 which operates all of the lights in the series. The first light 20 is the master and the remaining lights electrically connected thereto are slaves. Up to 40 lights may be electrically linked to one another.

Several combinations of light sources 28 may be used to create different embodiments of light 20. The first embodiment of light 20 in accordance with the present invention is light 76 shown in FIG. 1. Light 76 is provided with a single light source 28 which, in this embodiment, is fluorescent lamp 30 emitting white light. The fluorescent lamp may also be provided with a colored covering to provide red or blue "invisible" light, for example. Light 76 includes transparent, cylindrical housing 26 having end caps 22 and 24 secured to opposite ends thereof. Electrical cord 56 extends from end cap 24 having control box 64 located along the cord. Control box 64 includes switch 66 which is rotatable to control the intensity of light source 28. Switch 66 slides linearly in slot 68 formed in control box 64 to turn the light on and off. Light 76 is illustrated as being provided with this particular switch 66, however, light 76 may be adapted with any suitable type of switch. Plug 58 is provided at the end of electrical cord 56 for insertion into an electrical outlet. Extending from opposite end cap 24 is cord 78 having polarized connector 62 located at the end thereof for linking a plurality of lights 76 in series. Ballast 52 is located in housing 26 near end cap 22 and is electrically connected to fluorescent lamp 30 to regulate current entering the lamp.

Figure 3:
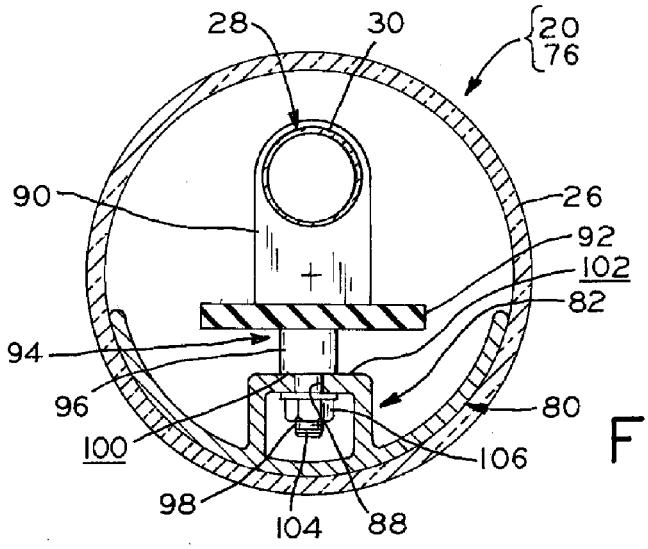
FIG. 3 is a sectional view of the light of FIG. 1 taken along line 3—3.

Referring to FIG. 3, mounted within cylindrical housing 26 is backbone support 80. Backbone support 80 is constructed from any suitable material which is lightweight yet sturdy enough to provide a base on which light source 28 is mounted. A suitable material may include aluminum. Backbone support 80 extends the length of light 76 and has a semi-circular cross section sized to engage the interior surface of housing 26. Protruding upwardly from the interior surface of backbone support 80 and integrally formed therewith is nut rail 82 having opening 88 defined therein. Light 76 is provided with backbone support 80 to add stability to light source 28, particularly when the light source is removed and replaced.

Fluorescent lamp 30 is mounted by contact posts 90 to a flat mounting plate 92 which extends the length of the light. Contact posts 90 stand upright, substantially perpendicularly to plate 92 being secured thereto by any suitable method. Contact posts 90 provide the electrical contacts for fluorescent lamp 30 to engage and complete the electrical circuit in light 76. As shown in FIG. 3, extending from the lower surface of plate 92 is mounting post 94 having larger diameter portion 96 and smaller diameter portion 98. The smaller diameter portion 98 is received in opening 88 defined in nut rail 82 with surface 100 of larger diameter portion 96 engaging surface 102 of the nut rail. End 104 of smaller diameter post portion 98 is threaded with nut 106 engaging the post portion to secure plate 92 having fluorescent lamp 30 mounted thereon to backbone support 80.

Figure 4:
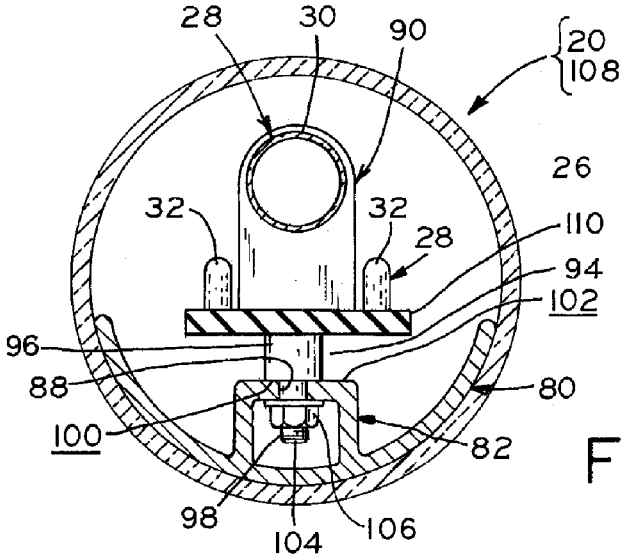
FIG. 4 is a sectional view of the light of FIG. 2 taken along line 4—4.

Referring to FIGS. 2 and 4, a second embodiment of a light in accordance with the present invention is shown. Light 108 is provided with two light sources 28 one of which is fluorescent lamp 30 emitting white light and LEDs 32 emitting red, blue, or UV light, for example. Light 108 is of similar construction to light 76 described above having transparent cylindrical housing 26 closed at both ends by end caps 22 and 24. Located in end cap 24 is a conventional electrical outlet 60 which as discussed previously may be used to link a plurality of lights in series. Alternatively, electrical outlet 60 may be used for providing electrical power to an electrical device such as a tool. Due to the fact that one of the light sources associated with this light is LEDs 32, plate 92 of the first embodiment is replaced by circuit board 110 to which the LEDs are mounted. Fluorescent lamp 30 is mounted to circuit board 110 by contact posts 90 as discussed above with respect to light 76. Also mounted to circuit board 110 is ballast 52 for regulating input current entering fluorescent lamp 30 and LED driver 54 for regulating the input current prior to illuminating LEDs 32. Circuit board 110 having fluorescent lamp 30 and LEDs 32 mounted thereto is secured within cylindrical housing 26 using backbone supports 80 as described above.

Located along electrical cord 56 extending from end cap 22 is control box 64 which is provided with switch 66 for operating fluorescent lamp 30 and LEDs 32. Switch 66 has three positions, one position being the off position as shown in FIG. 2, one position operating the fluorescent lamp and one position operating the LEDS. Switch 66 slides into one of the three positions and is rotatable to control the intensity of the light source. Light 108 is illustrated as being provided with switch 66; however, any suitable type of switch may be used to operate the light. The number of LEDs 32 mounted to circuit board 110 further defines the maximum intensity of the light emitted therefrom such that the more LEDs provided, the greater the maximum intensity.

A further embodiment of a light in accordance with the present invention is illustrated in FIG. 5. Light 112 is provided with one light source 28, LEDs 32, which are mounted to circuit board 110 extending longitudinally between end caps 22 and 24 of the light. Both red and white LEDs 32 are provided in light 112, being mounted to circuit board 110 in any suitable configuration. Light 112 may be provided with one row of white LEDs 32 and one row of red LEDs 32. Additionally, the red and white LEDs may be alternated. A further possibility includes the use of the dual color LEDs 34 illustrated in FIG. 6 and discussed above wherein each LED 34 has the capability of producing both red and white light. Besides the use of red and white light LEDs, other color LEDs could be selected such as blue, green, UV, or infrared.

Mounted to opposite ends of circuit board 110 are two LED drivers 54 and 54' with one driver provided for regulating the current supplied to each of the red and white LEDs 32. Light 112 is provided with push button stepping switch 122 located in end cap 24 for operation thereof, however, any suitable type of switch may be provided. With push button stepping switch 122 located in end cap 24, light 112 is not provided with means for electrically linking a plurality of lights. However, it is understood that push button stepping switch 122 may be positioned in a different location on the light and the light may be provided with an electrical outlet or polarized connector as illustrated in previous embodiments. Alternatively, a control box 64 could be employed in an easily accessible location to switch the light fixture between various colors of light to be emitted.

Figure 7A:
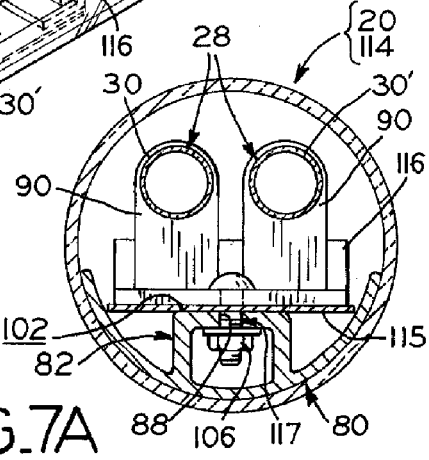
FIG. 7A is a section view of the light of FIG. 7 taken along line 7A—7A.

A fourth embodiment of a light in accordance with the present invention is illustrated in FIGS. 7 and 7A. Similarly to light 112, light 114 is provided with only one light source 28. Light 114 includes a pair of fluorescent lights 30 and 30' mounted to backbone 80 via brackets 116 and contact posts 90. Backbone 80 is provided including nut rail 82 to which brackets 116 are mounted in a similar manner to that described above. In this embodiment, mounting post 94 is removed. Reflective aluminum sheet 115 is located between brackets 116 and nut rail 82. As shown in FIG. 7, reflective aluminum sheet 115 extends the length of fluorescent lamps 30 and 30' to reflect light emitted therefrom. Threaded fastener 117 extends through bracket 116, reflective aluminum sheet 115, and opening 88 in nut rail 82 with nut 106 engaging fastener 117 to secure bracket 116 and sheet 115 to backbone 80. The fluorescent lamps 30 and 30' engage contact posts 90 at each end to complete the electrical circuit in the light. Contact posts 90 are mounted to L-shaped brackets 116 by fasteners 118, for example. Brackets 116 are constructed from any suitable material able to support lamps 30 and 30'. Also mounted to backbone 80 are two ballasts 52 and 52' which regulate current passing through each of the fluorescent lamps 30 and 30', respectively. In this embodiment, both lamps 30 and 30' are conventional fluorescent lights, however, in order to provide both white and red or blue light, fluorescent lamp 30' is covered with a red or blue, plastic material able to withstand the heat produced by the light.

Extending from end cap 22 is electrical cord 56 having plug 58 at a distal end of the cord for insertion into a conventional electrical outlet. Membrane switch 74 is located in end cap 24 being recessed inwardly from surface 25 of end cap 24 so as to protect membrane switch 74. Membrane switch 74 is provided with a plurality of buttons 75 which are used to operate light 114 including controlling the intensity of light sources 28. End cap 24 of light 114 is not provided with an electrical outlet or polarized connector, however, it is understood that end cap 24 may be adapted to include this feature if membrane switch 74 is located in a different position on light 114.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A light fixture comprising:

a base;

two light sources mounted on said base, wherein one of said two light sources is one of an incandescent light and a fluorescent light, each of said light sources emitting a different color of light;

an enclosure substantially surrounding said light sources, at least a portion of said enclosure formed from a transparent material to allow the passage of light therethrough; and a control for selectively energizing one or another of said light sources, whereby said light fixture emits one or another color of light.

2. The light fixture according to claim 1 wherein said light colors are selected from the group consisting of white, red, green, blue, infrared, and ultraviolet light.

3. The light fixture according to claim 1 wherein said control comprises an electrical switch.

4. The light fixture according to claim 1 wherein said light sources comprise a first fluorescent lamp which emits a first color of light, and a second fluorescent lamp having a colored covering, to thereby emit a second color of light.

5. The light fixture according to claim 1 wherein said light sources comprise a fluorescent lamp and at least one LED, said fluorescent lamp and LED emitting two different colors of light.

6. The light fixture according to claim 1 wherein said light fixture is elongated.

7. The light fixture according to claim 1 wherein said light fixture further comprises a dimmer to dim the intensity of the light emitted by said light fixture.

8. The light fixture according to claim 1, further comprising:

a backbone support mounted to said base, said backbone support substantially supporting said base within said enclosure.

9. The light fixture according to claim 8 wherein said enclosure comprises a pair of opposing ends, said light fixture further comprising:

a plurality of end caps secured to said opposing ends of said enclosure.

10. The light fixture of claim 9 wherein at least one of said plurality of end caps comprises an electrical service outlet.

11. The light fixture of claim 9 wherein at least one of said plurality of end caps comprises a polarized connector.

12. The light fixture of claim 1, further comprising:

a second light fixture, the first said light fixture electrically connected to said second light fixture in series, said second light fixture further comprising:

a base;

two light sources mounted on said base, each of said light sources emitting a different color of light; and an enclosure substantially surrounding said light sources; at least a portion of said enclosure allowing passage of light therethrough.

13. The light fixture of claim 1, further comprising:

a second light fixture, the first said light fixture electrically connected to said second light fixture in parallel, said second light fixture further comprising:

a base;

two light sources mounted on said base, each of said light sources emitting a different color of light;

an enclosure substantially surrounding said light sources; at least a portion of said enclosure allowing passage of light therethrough; and a control for selectively energizing one or another of said light sources, whereby said light fixture emits one or another color of light.

14. The light fixture of claim 1, further comprising:

a second light fixture, the first said light fixture electrically connected to said second light fixture in series, said second light fixture further comprising:

a first light source capable of emitting a first color of light selected from the group consisting of ultraviolet light and infrared light;

a second light source capable of emitting a second color of light; and an enclosure substantially surrounding said first and said second light sources, at least of portion of said enclosure allowing the passage of light therethrough.

15. The light fixture of claim 1, further comprising:

a second light fixture, the first said light fixture electrically connected to said second light fixture in parallel, said second light fixture further comprising:

a first light source capable of emitting a first color of light selected from the group consisting of ultraviolet light and infrared light;

a second light source capable of emitting a second color of light;

an enclosure substantially surrounding said first and said second light sources, at least of portion of said enclosure allowing the passage of light therethrough; and a control, said control having a first configuration for energizing said first light source and a second configuration for energizing said second light source.

16. A light fixture comprising:

a first light source capable of emitting a first color of light selected from the group consisting of ultraviolet light and infrared light;

a second light source capable of emitting a second color of light, wherein said second light source is one of an incandescent light and a fluorescent light;

an enclosure substantially surrounding said first and said second light sources, at least of portion of said enclosure formed from a transparent material to allow the passage of light therethrough; and a control, said control having a first configuration for energizing said first light source and a second configuration for energizing said second light source.

17. The light fixture according to claim 16, further comprising:

a base, said base connected to said first and said second light sources and substantially supporting said first and second light sources; and a backbone support mounted to said base, said backbone support substantially supporting said base, wherein said base and said backbone support are substantially contained within said enclosure.

18. The light fixture according to claim 16, wherein said enclosure comprises a pair of opposing ends, said light fixture further comprising:

a plurality of end caps secured to said opposing ends of said enclosure.

* * * * *